US007658352B2

(12) United States Patent
Gronbach

(10) Patent No.: US 7,658,352 B2
(45) Date of Patent: Feb. 9, 2010

(54) DEVICE TO FACILITATE STATIONARY PLACEMENT OF A PAINTBRUSH

(76) Inventor: Robert G. Gronbach, 9 Doris Dr., Newton, NJ (US) 07860

( * ) Notice: Subject to any disclaimer, the term of this patent is extended or adjusted under 35 U.S.C. 154(b) by 0 days.

(21) Appl. No.: 12/137,247

(22) Filed: Jun. 11, 2008

(65) Prior Publication Data

US 2009/0308988 A1 Dec. 17, 2009

(51) Int. Cl.
*A46B 17/00* (2006.01)

(52) U.S. Cl. ..... 248/111; 248/113; 248/690

(58) Field of Classification Search ..... 248/684, 248/690, 110, 111, 113
See application file for complete search history.

(56) References Cited

U.S. PATENT DOCUMENTS 1,653,374 A * 12/1927 Rossi ..... 15/248.1
2,309,990 A * 2/1943 Savi ..... 15/174
3,223,375 A * 12/1965 Bernasconi ..... 410/101
3,536,285 A * 10/1970 Vaughn ..... 248/309.4
5,035,386 A 7/1991 Tucker
5,044,038 A * 9/1991 Matkovic ..... 15/159.1
5,087,014 A * 2/1992 Desjardin ..... 248/692
5,297,695 A 3/1994 Provence
5,406,668 A 4/1995 Goodhue
5,476,240 A 12/1995 McDonough
6,244,559 B1 * 6/2001 Stanton ..... 248/692
6,419,194 B1 7/2002 LoSacco
6,609,685 B1 8/2003 Lamont
6,830,228 B2 * 12/2004 Ernst ..... 248/475.1

* cited by examiner

*Primary Examiner*—J. Allen Shriver, II
*Assistant Examiner*—Steven M Marsh
(74) *Attorney, Agent, or Firm*—Muskin & Cusick LLC

(57) ABSTRACT

An attaching mechanism to attach to a paintbrush. The attaching mechanism comprises a hook so that when the attaching mechanism is attached to a paintbrush, the paintbrush can be hung by the hook on a rim of a paint can.

6 Claims, 5 Drawing Sheets

DEVICE TO FACILITATE STATIONARY PLACEMENT OF A PAINTBRUSH

BACKGROUND OF THE INVENTION

1. Field of the Invention

The present inventive concept relates to an apparatus and method to facilitate placement of a paintbrush while it may be wet with paint in a convenient and practical position for a painter.

2. Description of the Related Art

When a painter is using a paintbrush to paint a medium, typically there is no easy way for the painter to put the paintbrush down. If the painter places the paintbrush down on the floor, then typically paint will drip off from the paintbrush. Sometimes painters may place the paintbrush on top of the paint can, but this also subjects the paintbrush to dripping and falling.

What is needed is a way in which a painter can locate his or her paintbrush which may be full of paint in a manner in which it will be easy to reach and will reduce or eliminate unwanted dripping onto a clean surface.

SUMMARY OF THE INVENTION

It is an aspect of the present general inventive concept to provide an easy manner in which a painter can temporarily place his or her paintbrush in a stable position.

The above aspects can also be obtained by a method that includes (a) a hook attached to a shaft; (b) a plate attached to an end of the shaft; and (c) a plurality of teeth attached at an end of the plate, the teeth pointing in an opposite direction from the hook.

The above aspects can also be obtained by a method that includes (a) providing an attaching mechanism comprising: (i) a hook attached to a shaft; (ii) a plate attached to an end of the shaft; (iii) a plurality of teeth attached at an end of the plate, the teeth pointing in an opposite direction from the hook; (b) attaching the attaching mechanism to a paintbrush; and (c) hanging the paintbrush from the hook on a lid of a paint can.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1A:
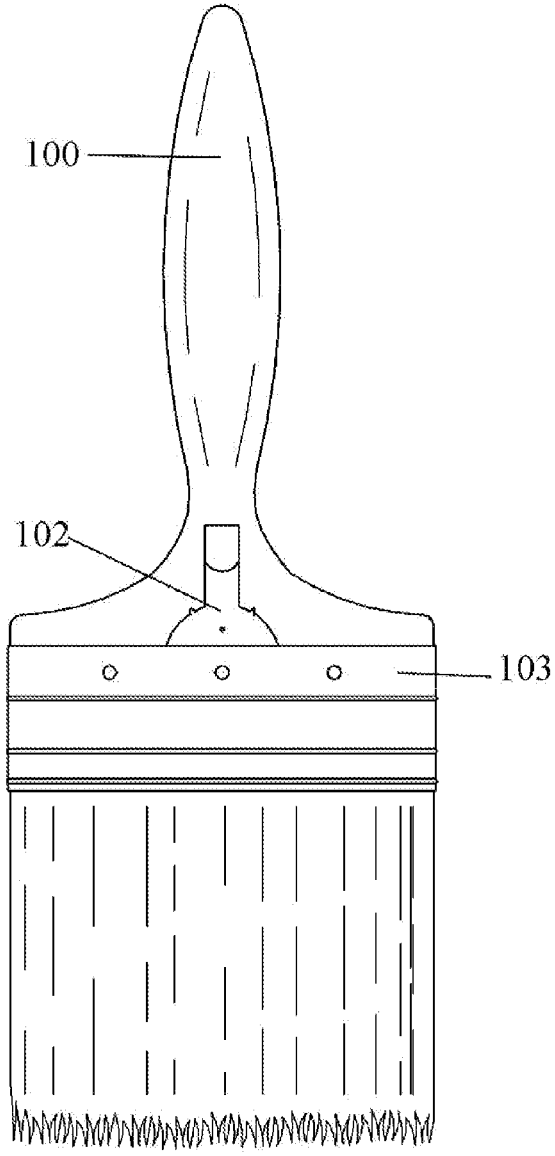
FIG. 1A is a front view of a paintbrush with an attachment mechanism attached to the paintbrush, according to an embodiment.

Reference will now be made in detail to the presently preferred embodiments of the invention, examples of which are illustrated in the accompanying drawings, wherein like reference numerals refer to like elements throughout.

FIG. 1A is a front view of a paintbrush with an attachment mechanism attached to the paintbrush, according to an embodiment.

A paintbrush 100 can be any type of known paintbrush, e.g., any shape, dimensions, etc. An attachment mechanism 102 is attached to the paintbrush 100 so that the paintbrush can be easily hung from an inside of a paint can (see FIG. 4). A ferrule 103 may come attached to a standard paintbrush. The paintbrush can be made out of wood, or can also be made out of any other material, such as plastic, etc.

Figure 1B:
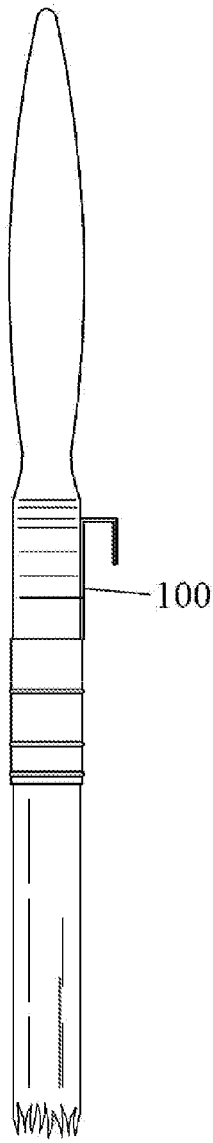
FIG. 1B is a side view of a paintbrush with an attachment mechanism attached to the paintbrush, according to an embodiment.

FIG. 1B is a side view of a paintbrush with an attachment mechanism attached to the paintbrush, according to an embodiment.

A paintbrush 100 is attached to an attachment mechanism 102.

Figures 2A, 2B:
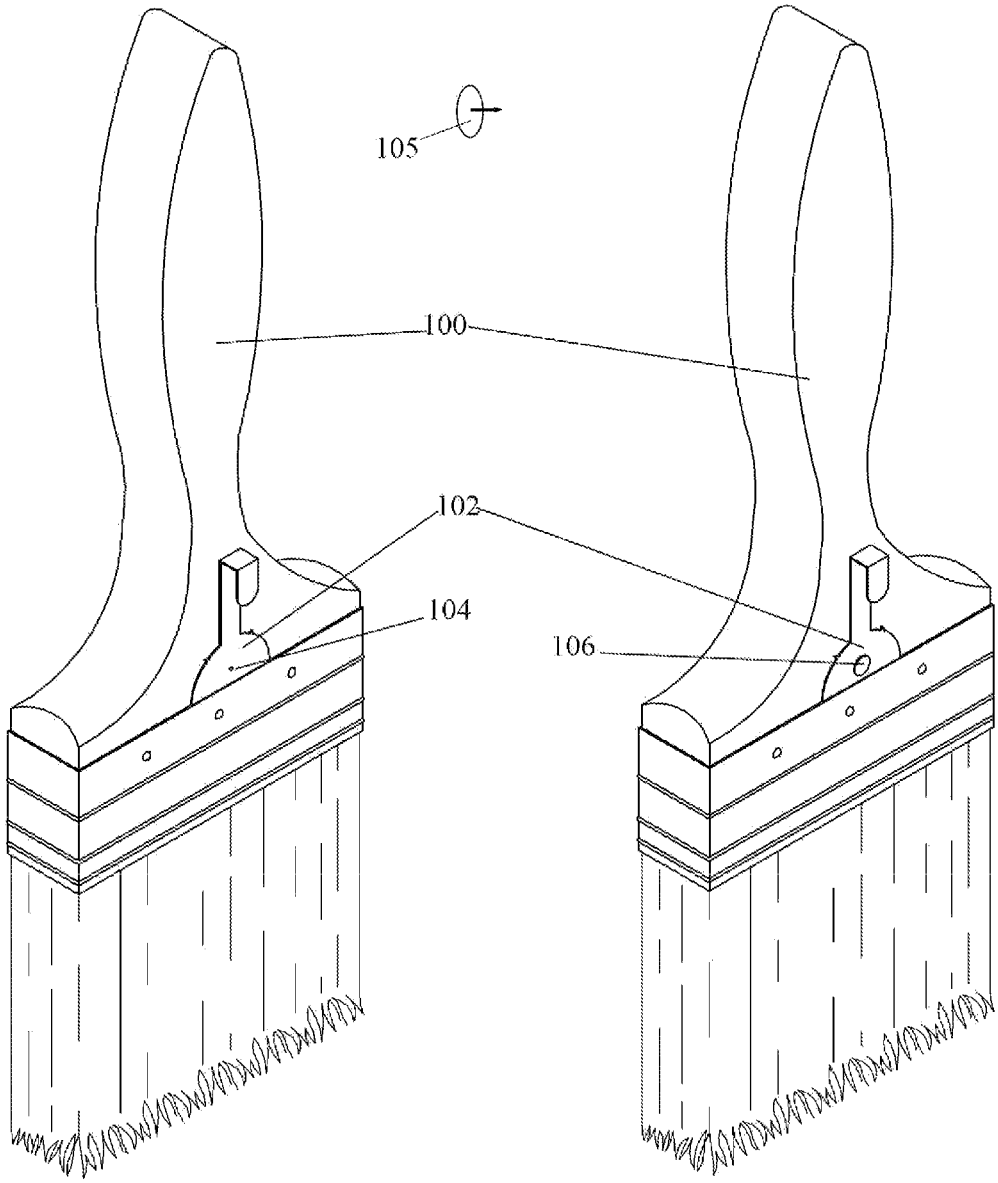
FIG. 2A is an orthographic view of a paintbrush with an attachment mechanism attached to the paintbrush, according to an embodiment.
FIG. 2B is an orthographic view of a paintbrush with an attachment mechanism including a tack attached to the paintbrush, according to an embodiment.

FIG. 2A is an orthographic view of a paintbrush with an attachment mechanism attached to the paintbrush, according to an embodiment.

An attaching mechanism 102 is attached to a paintbrush 100. The attaching mechanism 102 has a hole 104 in the attaching mechanism 102 so that a standard tack (not pictured in FIG. 2A) can be inserted through the hole and into the paintbrush 100. The tack would help keep the attaching mechanism 102 attached to the paintbrush 100.

A tack 105 is shown which can be used to press through the hole 104 and into the paintbrush 100.

FIG. 2B is an orthographic view of a paintbrush with an attachment mechanism including a tack attached to the paintbrush, according to an embodiment.

An attaching mechanism 102 is attached to the paintbrush 100. A tack 106 is inserted through the hole (not visible in FIG. 2B) in the attaching mechanism 102 and into the paintbrush 100. Instead of using a tack, a screw (or any other attaching mechanism) can also be used in place of the tack to screw through the hole 104 and into the paintbrush 100.

Figure 3A:
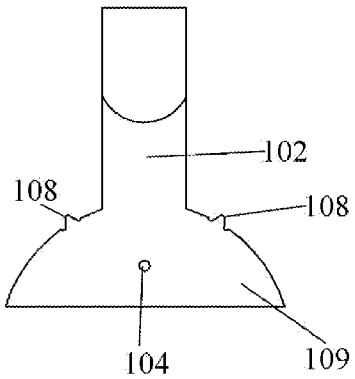
FIG. 3A is a front view of an attachment mechanism, according to an embodiment.

FIG. 3A is a front view of an attachment mechanism, according to an embodiment.

An attaching mechanism 102 comprises a plate 109, which can be semicircular in shape, although any other shapes can be used as well (square, rectangular, round, etc.) A pair of teeth 108 is located on a top end of the plate 109. The teeth are used to insert into a paintbrush in order to secure the attaching mechanism 102 into the paintbrush. The teeth are preferably sharp so that they can puncture the wood material of the paintbrush and insert (and stay) inside the paintbrush. A tack (not pictured) comprises a head attached to a pin. Hole 104 is used so that a pin of a tack can be inserted through the hole 104 and into the wood material of a paintbrush.

Figure 3B:
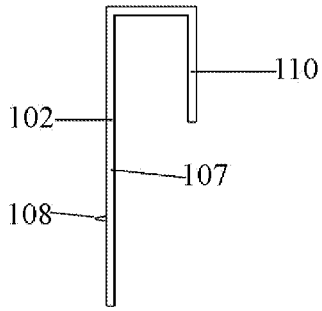
FIG. 3B is a side view of an attachment mechanism, according to an embodiment.

FIG. 3B is a side view of an attachment mechanism, according to an embodiment.

Figure 4:
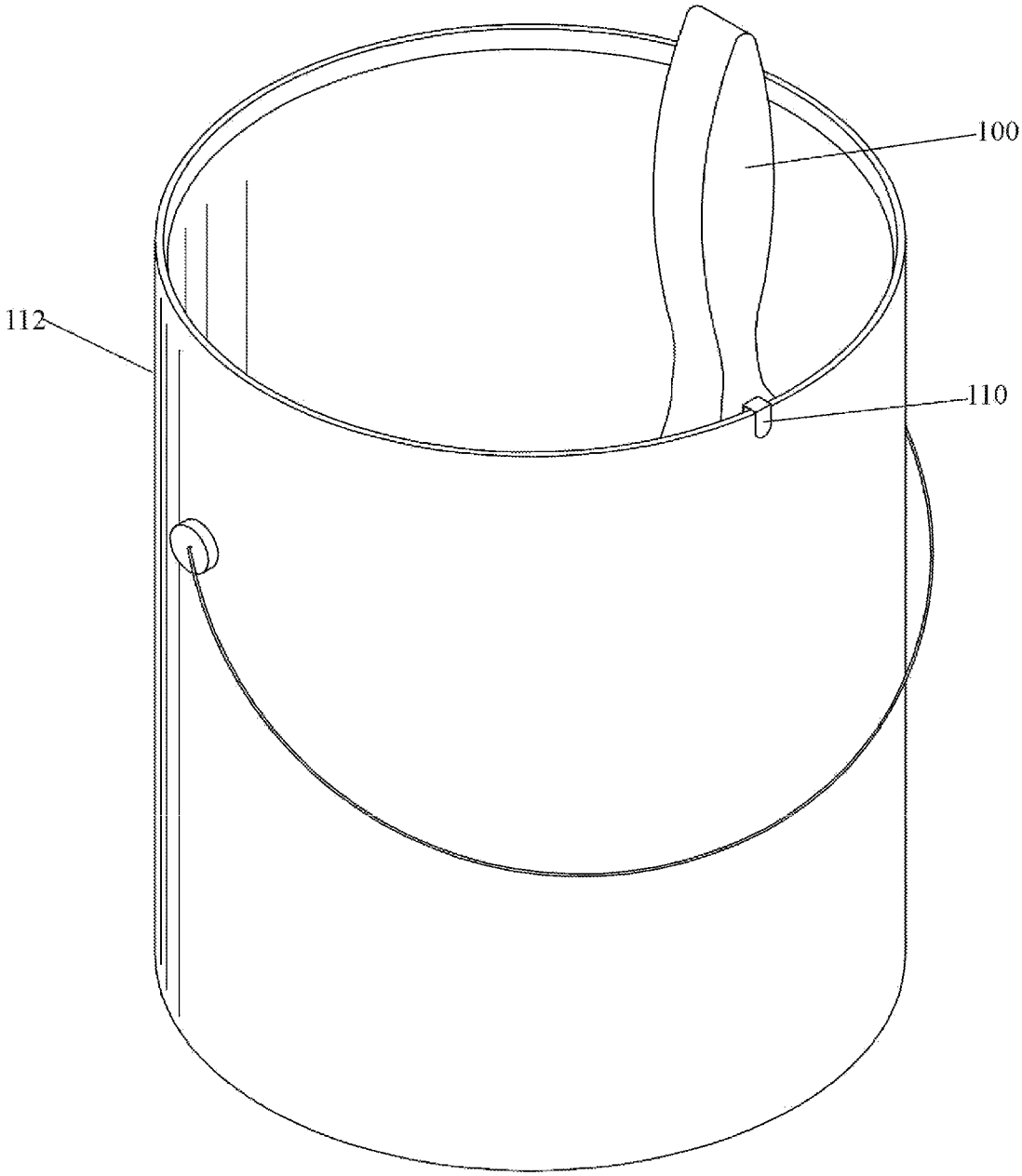
FIG. 4 is an orthographic view of a paintbrush temporarily attached to a paint can using an attachment mechanism attached to the paintbrush, according to an embodiment.

A hook 110 is used to hang the attaching mechanism 102 (attached to a paintbrush) on a top rim of a paint can (see FIG. 4). A shaft 107 connects the hook 110 to the plate 109. Teeth 108 protrude from the attaching mechanism in a direction which is opposite the direction in which the hook 110 extends from the shaft 107.

Figure 3C:
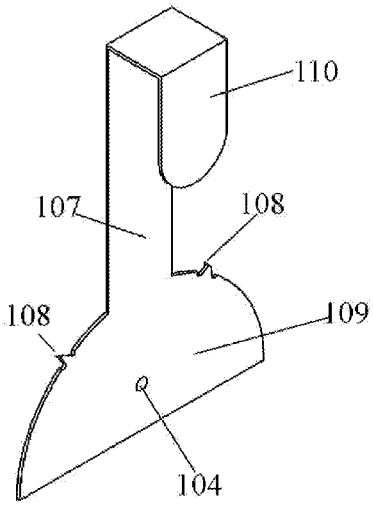
FIG. 3C is an orthographic view of an attachment mechanism, according to an embodiment.

FIG. 3C is an orthographic view of an attachment mechanism, according to an embodiment.

The hook 110 is attached to the shaft 107 which is connected to the plate 109. The plate has a hole 104 and teeth 108 (although any number of teeth can be used).

Figure 3D:
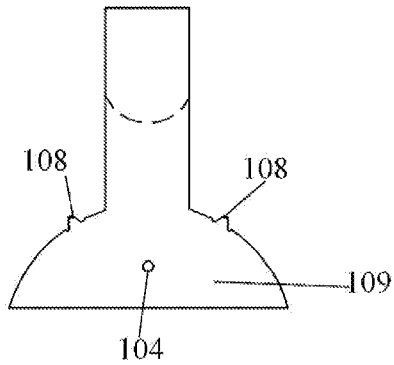
FIG. 3D is a rear view of an attachment mechanism, according to an embodiment.

FIG. 3D is a rear view of an attachment mechanism, according to an embodiment.

The hole is in the center of the plate 109. The two teeth 108 protrude in a direction which is to be towards the paintbrush which is to be attached to the attaching mechanism.

FIG. 4 is an orthographic view of a paintbrush temporarily attached to a paint can using an attachment mechanism attached to the paintbrush, according to an embodiment.

A paintbrush 100 which has the attaching mechanism attached to it hangs from a rim of a paint can 112 by a hook 110 of the attaching mechanism.

Figure 5A:
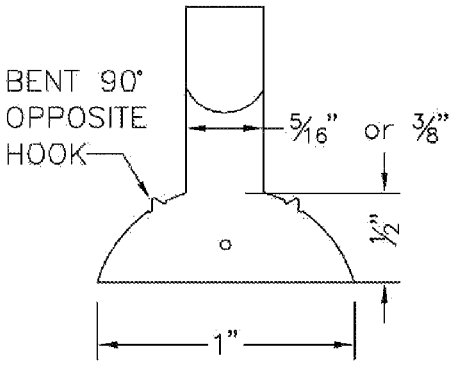
FIGS. 5A, 5B, and 5C are view of the attachment mechanism showing possible dimensions.
Figure 5B:
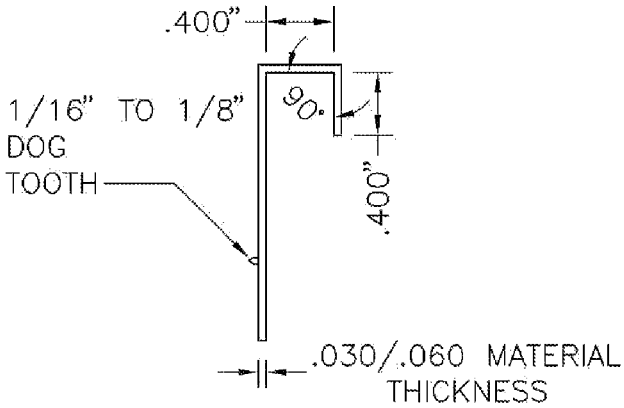
Figure 5C:
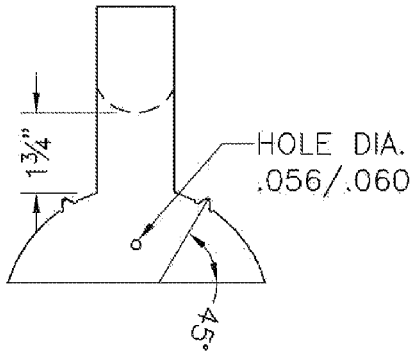

FIGS. 5A, 5B, and 5C are view of the attachment mechanism showing possible dimensions.

The dimensions shown in FIGS. 5A, 5B, and 5C are of course only one possible configuration of dimensions. It can be appreciated by one skilled in the art that other dimensions can be implemented as well.

The attaching (or attachment) mechanism can be made of metal, such as aluminum, or any other metal. It can also be made out of any other material, such as plastic, wood, etc.

In this manner, a painter can conveniently hang the paintbrush 100 onto the paint can 112, thereby allowing paint to drip from the paintbrush 100 back down inside the paint can 112. This also frees the painter's hands up to do other things as the painter is not concerned with the safety or stains of the dripping paint.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An attaching mechanism to attach to a paintbrush, the attaching mechanism comprising:

a hook attached to an end of a shaft;

a plate attached to an end of the shaft, the plate comprising a continuously straight and flat bottom end, the bottom end being on an opposite end of the attaching mechanism than a top surface of the hook, wherein the shaft is narrower than the plate;

a plurality of teeth attached to the plate, the teeth pointing in an opposite direction than the hook; and a hole located in a middle portion of the plate, wherein the hook, plate, and shaft are integrated in one piece wherein the plate is approximately shaped in a semi-circle.

2. An attaching mechanism to attach to a paintbrush, the attaching mechanism comprising:

a hook attached to an end of a shaft;

a plate attached to an end of the shaft, the plate comprising a continuously straight and flat bottom end, the bottom end being on an opposite end of the attaching mechanism than a top surface of the hook, wherein the shaft is narrower than the plate;

a plurality of teeth attached to the plate, the teeth pointing in an opposite direction than the hook;

a hole located in a middle portion of the plate, wherein the hook, plate, and shaft are integrated in one piece; and a paintbrush attached to the attaching mechanism.

3. The attaching mechanism as recited in claim 2, further comprising a tack inserted through the hole and affixed into the paintbrush.

4. A method to attach to a paintbrush, the method comprising:

providing an attaching mechanism comprising:

a hook attached to an end of a shaft;

a plate attached to an end of the shaft, the plate comprising a continuously straight and flat bottom end, the bottom end being on an opposite end of the attaching mechanism than a top surface of the hook, wherein the shaft is narrower than the plate;

a plurality of teeth attached to the plate, the teeth pointing in an opposite direction from than the hook;

a hole located in a middle portion of the plate, the hole being vertically aligned with the shaft;

wherein the hook, plate, and shaft are integrated in one piece;

attaching the attaching mechanism to a paintbrush by placing the bottom end against a ferrule of the paintbrush and inserting a pointed object through the hole and into the paintbrush; and hanging the paintbrush from the hook on a lid of a paint can.

5. The method as recited in claim 4, wherein the plate is approximately shaped in a semi-circle.

6. The method as recited in claim 4, wherein the pointed object is a tack.

* * * * *